US009719279B2

(12) United States Patent
Subliskey et al.

(10) Patent No.: US 9,719,279 B2
(45) Date of Patent: Aug. 1, 2017

(54) COMBINATION WINDOW SASH LOCK AND TILT MECHANISM

(71) Applicant: Truth Hardware, Owatonna, MN (US)

(72) Inventors: Edward J. Subliskey, Owatonna, MN (US); Jimmie W. Worrell, Owatonna, MN (US)

(73) Assignee: Truth Hardware, Owatonna, MN (US)

( * ) Notice: Subject to any disclaimer, the term of this patent is extended or adjusted under 35 U.S.C. 154(b) by 0 days.

(21) Appl. No.: 14/318,244

(22) Filed: Jun. 27, 2014

(65) Prior Publication Data

US 2015/0376920 A1 Dec. 31, 2015

(51) Int. Cl.

| | |
|---|---|
| ***E05C 1/12*** | (2006.01) |
| ***E05C 9/02*** | (2006.01) |
| ***E05C 3/04*** | (2006.01) |
| *E05C 7/00* | (2006.01) |

(52) U.S. Cl.

CPC ..... *E05C 1/12* (2013.01); *E05C 3/045* (2013.01); *E05C 9/025* (2013.01); *E05C 2007/007* (2013.01)

(58) Field of Classification Search

CPC .... E06B 3/5054; E06B 3/5063; E06B 3/5081; E05C 9/00; E05C 9/006; E05C 9/04; E05C 9/041; E05C 9/043; E05C 9/046; E05C 1/00; E05C 1/002; E05C 1/08; E05C 1/12; E05C 1/16; E05B 65/0864; E05B 65/087; E05B 65/0876; E05B 65/0882; Y10T 292/0802; Y10T 292/0836; Y10T 292/0837; Y10T 292/0839; Y10T 292/084; Y10T 292/0846

USPC ..... 49/176, 181, 183, 184, 185, 395, 449; 292/241, DIG. 27, DIG. 40

See application file for complete search history.

(56) References Cited

U.S. PATENT DOCUMENTS

| | | | | |
|---|---|---|---|---|
| 5,090,750 | A | 2/1992 | Lindqvist | |
| 5,244,238 | A * | 9/1993 | Lindqvist | E05B 65/0841 292/36 |
| 5,301,989 | A | 4/1994 | Dallmann et al. | |
| 5,791,700 | A | 8/1998 | Biro | |
| 5,901,499 | A | 5/1999 | Delaske et al. | |
| 5,992,907 | A | 11/1999 | Sheldon et al. | |
| 6,546,671 | B2 | 4/2003 | Mitchell et al. | |
| 6,565,133 | B1 | 5/2003 | Timothy | |
| 6,817,142 | B2 | 11/2004 | Marshik | |
| 6,925,758 | B2 | 8/2005 | Pettit | |
| 6,957,513 | B2 | 10/2005 | Pettit et al. | |
| 7,010,946 | B2 | 3/2006 | Hahn | |
| 7,013,603 | B2 | 3/2006 | Eenigenburg et al. | |
| 7,322,619 | B2 * | 1/2008 | Nolte | E05B 53/003 292/175 |
| 7,481,470 | B2 | 1/2009 | Eenigenburg et al. | |

(Continued)

OTHER PUBLICATIONS

Truth Hardware, 19 Fusion System, accessed online on Jun. 26, 2014, 12 pgs.

*Primary Examiner* — Katherine Mitchell
*Assistant Examiner* — Catherine A Kelly

(57) ABSTRACT

An apparatus has a housing adapted to be secured to a window sash. A cam rotatably mounted in the housing has a cam surface and a cam boss disposed opposite the cam surface. A drive disc rotatably mounted proximate the cam has a disc boss and a projection disposed opposite the disc boss. The cam boss and disc boss are selectively engageable when the cam is rotated.

16 Claims, 8 Drawing Sheets

(56) References Cited

U.S. PATENT DOCUMENTS

| | | | | |
|---|---|---|---|---|
| 7,490,873 | B1 * | 2/2009 | Ricke et al. | 292/5 |
| 7,607,262 | B2 | 10/2009 | Pettit et al. | |
| 7,963,577 | B2 * | 6/2011 | Wolf | 292/241 |
| 7,976,077 | B2 * | 7/2011 | Flory | E05B 53/003 292/241 |
| 8,020,904 | B2 | 9/2011 | Flory et al. | |
| 8,132,369 | B2 | 3/2012 | Pettit et al. | |
| 8,955,255 | B2 * | 2/2015 | DeBoer | E05B 53/003 49/176 |
| 2003/0084614 | A1 | 5/2003 | Pettit et al. | |
| 2003/0110698 | A1 | 6/2003 | Polowinczak et al. | |
| 2003/0110699 | A1 | 6/2003 | Eenigenburg et al. | |
| 2003/0205903 | A1 | 11/2003 | Kelley et al. | |
| 2004/0168370 | A1 | 9/2004 | Pettit et al. | |
| 2004/0200150 | A1 | 10/2004 | Kelley et al. | |
| 2004/0221513 | A1 | 11/2004 | Pettit | |
| 2005/0016067 | A1 | 1/2005 | Pettit et al. | |
| 2006/0192391 | A1 * | 8/2006 | Pettit | E05C 9/046 292/5 |
| 2006/0207181 | A1 | 9/2006 | Polowinczak et al. | |
| 2007/0180770 | A1 | 8/2007 | Flory et al. | |
| 2009/0241429 | A1 | 10/2009 | Polowinczak et al. | |
| 2010/0050528 | A1 | 3/2010 | Pettit et al. | |
| 2011/0012373 | A1 * | 1/2011 | Ramsauer | 292/138 |
| 2013/0214545 | A1 * | 8/2013 | Wolf et al. | 292/241 |
| 2015/0330121 | A1 | 11/2015 | Liang et al. | |

* cited by examiner

COMBINATION WINDOW SASH LOCK AND TILT MECHANISM

BACKGROUND

Window sash locks prevent vertical movement of a window sash by selectively engaging a rotatable cam disposed on a first window sash with a fixed keeper disposed on a second window sash. Typically, window sash locks are disposed proximate a central portion of a window sash. Tilt latches allow a window sash to be tilted inward to be cleaned and/or replaced. Typically, tilt latches are disposed proximate sides of the window sash and include a tab to pull a latch from engagement with the window jamb. Once disengaged, the window sash can be tilted. Some combination window lock and tilt latch systems exist. In one approach, a hook connected to a window sash lock engages a connecting element that is part of a hidden mechanical linkage. Such a system is difficult to assemble by a window manufacturer, in part because the mating hook and connecting elements are largely not visible during assembly.

SUMMARY

In one aspect, the technology relates to an apparatus having: a housing adapted to be secured to a window sash; a cam rotatably mounted in the housing, wherein the cam has a cam surface and a cam boss disposed opposite the cam surface; and a drive disc rotatably mounted proximate the cam, wherein the drive disc has a disc boss and a projection disposed opposite the disc boss, wherein the cam boss and disc boss are selectively engageable when the cam is rotated. In an embodiment, the cam is oriented substantially parallel to the drive disc. In another embodiment, the cam is rotatably positionable in: a locked position, wherein a portion of the cam surface projects from the housing, and wherein the cam boss and the disc boss are not in contact; an unlocked position, wherein the cam surface is disposed in the housing; and a ready position, wherein the cam boss and the disc boss in contact such that a further rotation of the cam rotates the drive disc. In yet another embodiment, the tilt latch is disposed remote from the housing, wherein the tilt latch has: a latch housing; and a latch movably disposed in the latch housing; and a linkage connecting the latch to the projection. In still another embodiment, when the cam is in the ready position, the further rotation of the drive disc moves the linkage so as to retract the latch into the latch housing.

In another embodiment of the above aspect, the cam is rotatably positionable in: an unlatched position, wherein the cam boss and the disc boss are in contact such that a rotation of the cam rotates the drive disc, and wherein the latch is fully retracted into the latch housing. In an embodiment, an axis of rotation of the cam is offset from a center point of the drive disc. In another embodiment, the cam has an axle and the drive disc defines an opening for receiving the axle, wherein the opening is offset from a center of the drive disc.

In another aspect, the technology relates to an apparatus having: a lock including: a lock housing; a cam rotatably disposed in the lock housing; and a drive disc connected to the cam, wherein a rotation of the cam selectively rotates the drive disc, wherein the drive disc has a projection; a tilt latch disposed remote from the lock housing, the tilt latch having: a latch housing; a latch movably disposed in the latch housing; and a linkage connecting the latch to the projection. In an embodiment, the apparatus has: a locked position, wherein at least a portion of the cam projects from the lock housing and wherein at least a portion of the latch projects from the latch housing; an unlocked position, wherein the cam is disposed within the lock housing; and an unlatched position, wherein the latch is retracted into the latch housing. In another embodiment, the apparatus further includes a spring that biases the latch into an extended position projecting from the housing. In yet another embodiment, the drive disc is disposed in the housing. In still another embodiment, the drive disc is disposed remote from the housing.

In another embodiment of the above aspect, the cam has an axle and the drive disc defines an opening for receiving the axle, wherein the opening is offset from a center of the drive disc. In an embodiment, the cam has a cam surface and a cam boss disposed opposite the cam surface; and wherein the drive disc has a disc boss and a projection disposed opposite the disc boss, wherein the cam boss and disc boss are selectively engageable when the cam is rotated. In another embodiment, each of the drive disc, the tilt latch, and the linkage are adapted to be disposed in a window sash.

In another aspect, the technology relates to a method of unlatching a tilt window with a window lock having a cam having a cam boss and a drive disc having a disc boss and a projection, the method including: rotating the cam from a locked position to an unlocked position; rotating the cam from the unlocked position to a ready position, wherein when in the ready position, the cam boss is engaged with the disc boss; rotating the cam from the actuated position through an retracting range, wherein when in the retracting range, rotation of the cam rotates the disc. In an embodiment, the projection is connected via a linkage to a latch disposed in a latch housing, where the latch is biased into a position projecting out of the latch housing. In another embodiment, rotating the cam through the retracting range rotates the disc such that the projection retracts the latch into the latch housing. In yet another embodiment, rotating the cam to an unlatched position, wherein when in the unlatched position, the latch is maximally retracted into the latch housing.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

Figure 1:
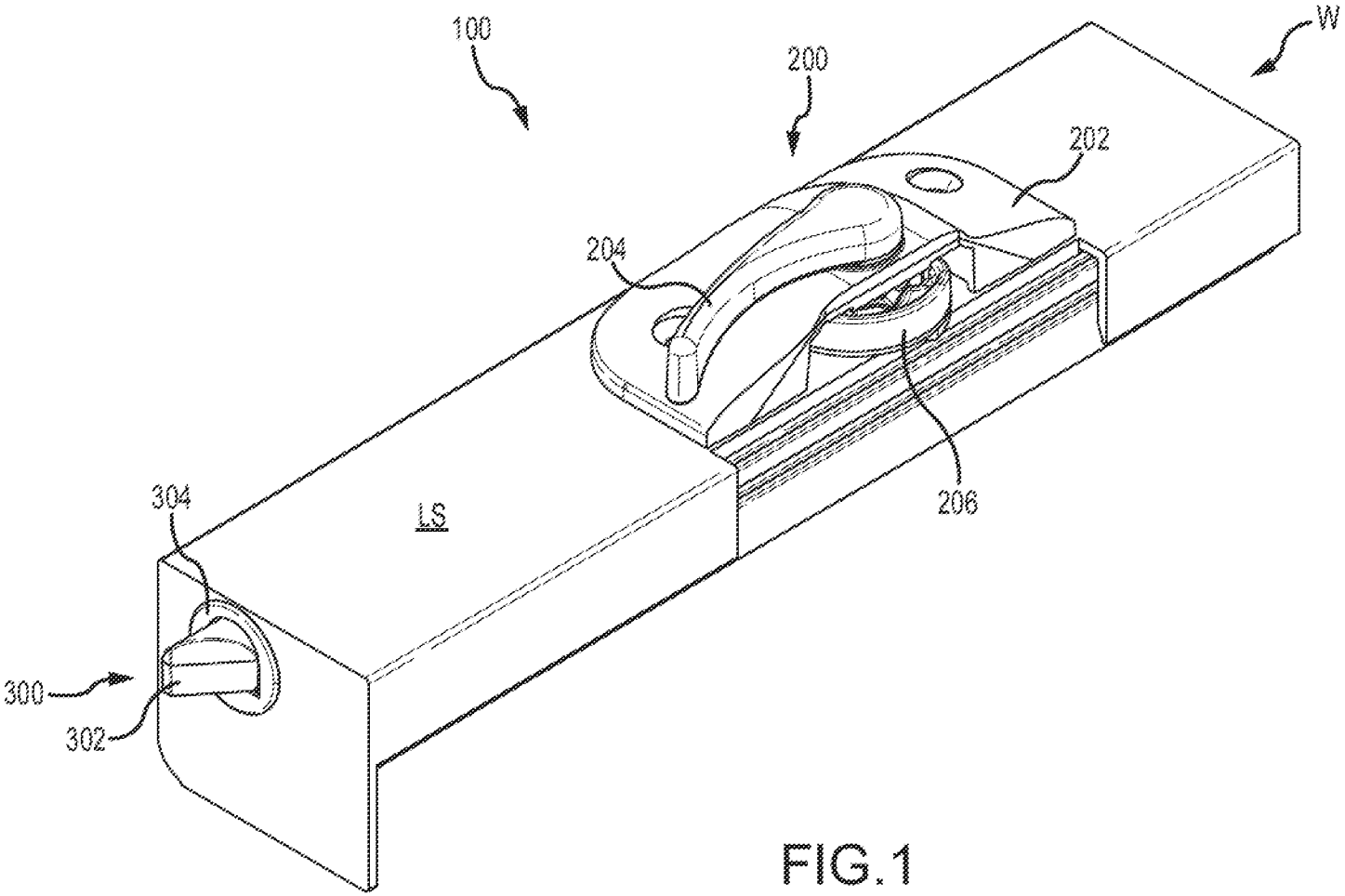
FIG. 1 is a perspective view of a window lock system for a tilt window, in the locked position.

FIG. 1 is a perspective view of a window lock system 100 for a tilt window W, in the locked position. The window lock system 100 includes a window lock 200 and a tilt latch 300 connected thereto, as described below. The window lock 200 is installed on an upper surface of a lower sash LS of a window W and includes a housing 202 fixed thereto. A lever 204 is rotatably connected to the housing 202 to actuate both the window lock 200 and the tilt latch 300. As described further herein, rotation of the lever 204 rotates a cam 206 to lock the window to a keeper on an opposite, upper sash, and also retracts a latch 302 disposed in a latch housing 304 of the tilt latch 300. In general, certain components of the window lock 200 are disposed on the upper surface of the lower sash LS, while the tilt latch 300 is disposed within the lower sash LS.

Figure 2A:
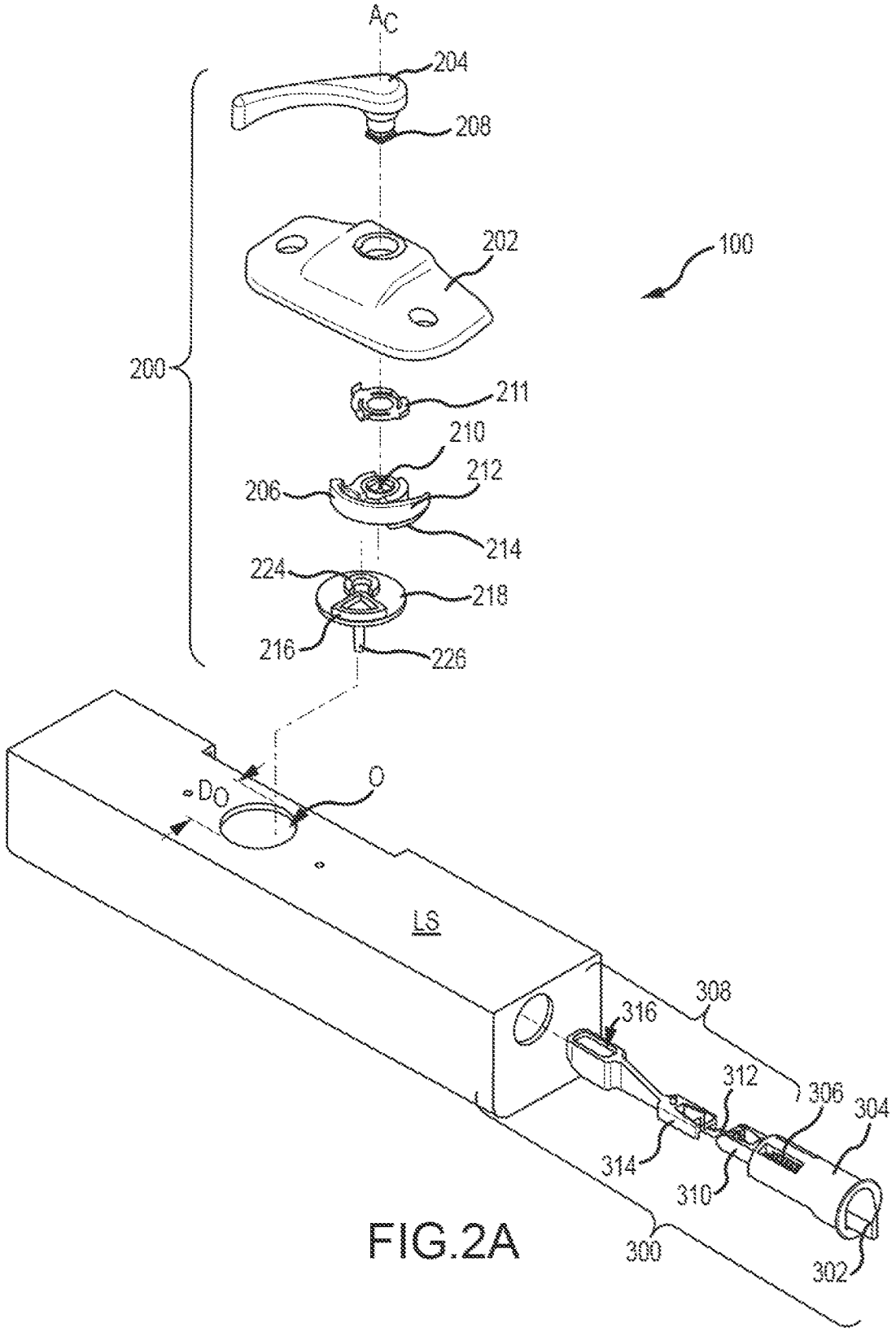
FIG. 2A is an exploded perspective view of the window lock system of FIG. 1.

FIG. 2A is an exploded perspective view of the window lock system 100 of FIG. 1. The window lock system 100 includes the window lock 200 having the housing 202 adapted to be secured to the upper surface of the lower window sash LS. The lever 204 is rotatably engaged with the housing 202 and includes a tailpiece 208 that engages with an opening 210 in the cam 206. A bushing 211 may be disposed above the cam 206. Rotation of the lever 204 rotates the cam 206 about a cam axis $A_C$. In this embodiment, the cam 206 is generally disc-shaped. The cam 206 includes a cam surface 212 that is configured to selectively engage with a keeper on an upper sash of a window so as to lock the window. A cam boss 214 projects from an underside of the cam 206 (opposite the cam surface 212) and is configured to selectively engage a disc boss 216 on a drive disc 218. The drive disc 218 is disposed below and generally parallel to the cam 206. A portion of the drive disc 218 is disposed within an opening O in the lower sash LS. The opening O has a diameter $D_O$. In other embodiments, the drive disc 218 may be completely disposed in the opening O. Contact between the cam boss 214 and the disc boss 216 rotates the drive disc 218 about a disc axis $A_D$. In certain embodiments, a spacer 224 has a height substantially similar to that of the disc boss 216. The spacer 224 may be positioned on the drive disc 218 to maintain spacing and alignment between the drive disc 218 and the cam 206. A disc projection 226 extends from a bottom surface of the drive disc 218 (opposite the disc boss 216).

The tilt latch 300 includes a latch housing 304 and a latch 302 slidably disposed therein. A spring 306 biases the latch 302 into an extended position, where it projects from the latch housing 304. A linkage 308 is configured to link rotational movement of the disc projection 226 to sliding, linear movement of the latch 302. The linkage 308, in the depicted embodiment, includes a latch link 310 connected to the latch 302. In certain embodiments, the latch link 310 and latch 302 can be integrally formed. A connection 312, which may be in the form of a wire, bar, rod, or other element, connects the latch link 310 to a projection link 314. The projection link 314 defines an opening 316 adapted to receive the disc projection 226.

Figure 2B:
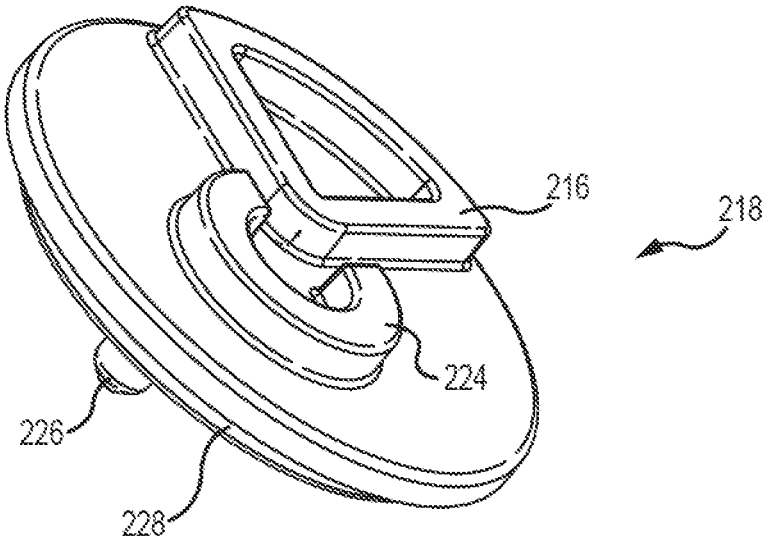
FIG. 2B is an upper perspective view of a drive disc utilized in the window lock system of FIG. 2A.
Figure 2C:
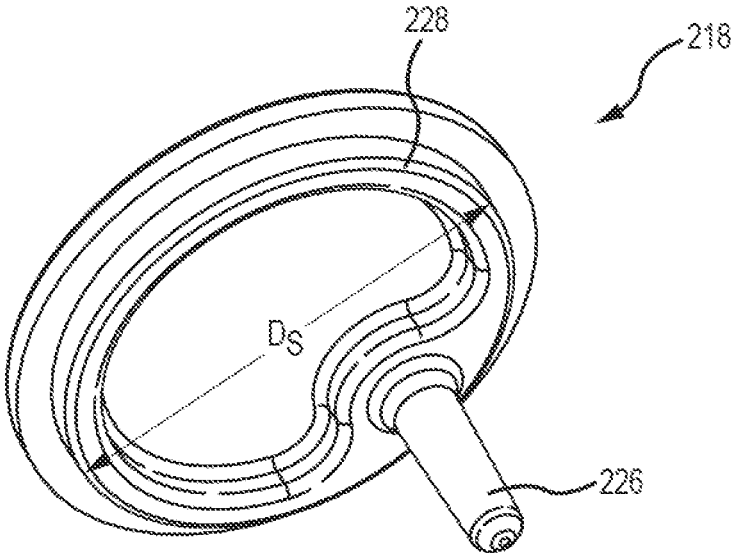
FIG. 2C is a lower perspective view of the drive disc of FIG. 2B.

FIGS. 2B and 2C depict upper and lower perspective views, respectively, of the drive disc 218. The drive disc 218 is described generally above and may also include a shoulder 228 that projects from an underside of the drive disc 218. The shoulder 228 has an outer shoulder diameter $D_S$ that is substantially similar to the opening diameter $D_O$ of the window sash LS. This allows for smooth movement during rotation of the drive disc 218 (via rotation of the lever 204).

Figure 3A:
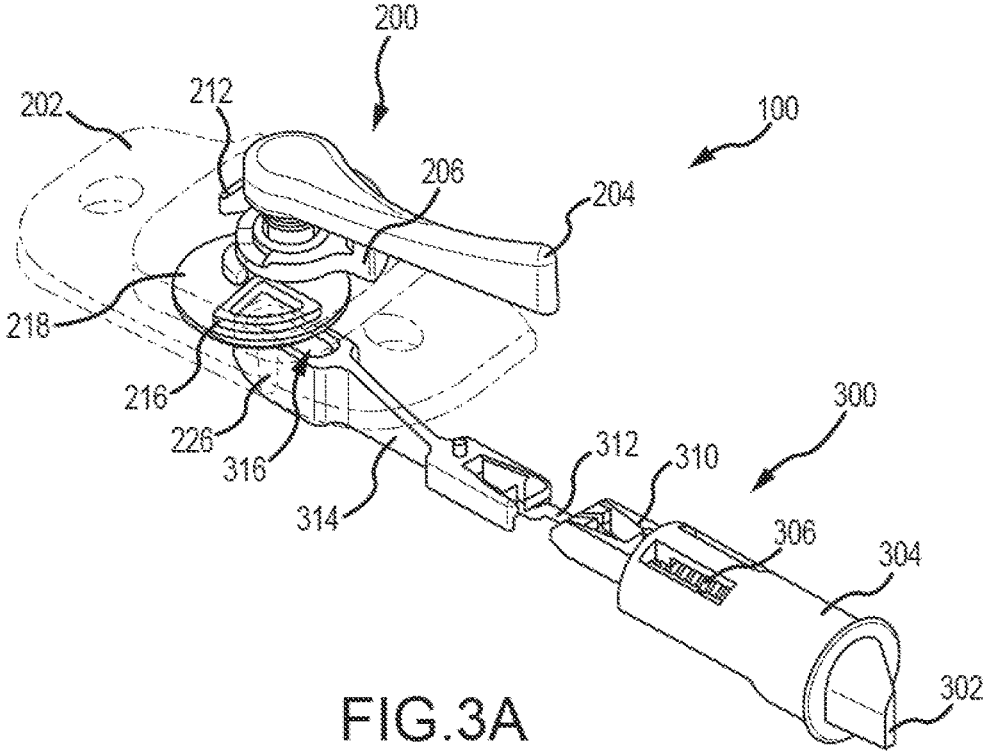
FIG. 3A is a perspective view of the window lock system of FIG. 1, in a locked position.
Figure 3B:
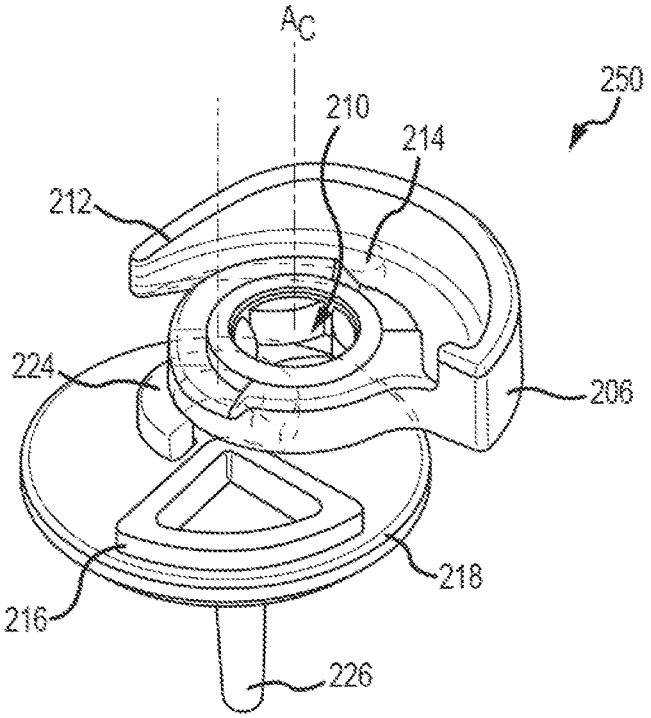
FIG. 3B is a perspective view of the drive system of the window lock system of FIG. 3A, in the locked position.

FIG. 3A is a perspective view of the window lock system 100, in a locked position. FIG. 3B is a perspective view of a drive system 250 of the window lock system 100, also in the locked position. FIGS. 3A and 3B are described together. A number of elements are described above with regard to FIGS. 1-2C and, accordingly, are not described further. When the window lock system 100 is in the locked position, the lever 204 is in a first position, defined here as 0 degrees. In the locked position, the cam extends from the housing 202 (see FIG. 1) and is engaged with a keeper (not shown) on an upper sash. In this position, the cam boss 214 is not engaged with the disc boss 216. Thus the latch 302 is not retracted and the spring 306 biases the latch 302 out of the latch housing 304 so as to engage the latch 302 with a jamb channel of the window. This engagement prevents the lower window sash from tilting during lifting and lowering thereof.

Figure 6:
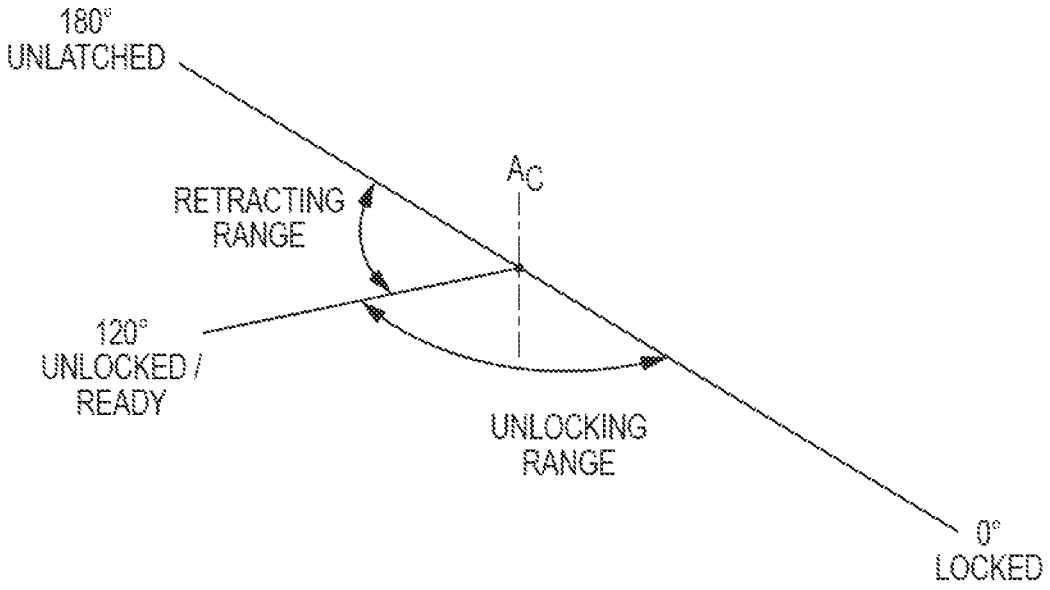
FIG. 6 depicts a range of motion of one embodiment of a window lock system.

One embodiment of the range of motion of the lever 204 is depicted in FIG. 6, where the locked position is depicted as 0 degrees. As the lever 204 is rotated, out of the locked position and into an unlocking range, the cam surface 212 begins to disengage from the keeper. The lever 204 is rotated through the unlocking range to an unlocked position. In the unlocked position, the cam surface 212 is no longer engaged with the keeper and the window sash can be raised and lowered. In the depicted embodiment, this unlocked position is reached when the lever 204 rotates about 120 degrees.

Figure 4A:
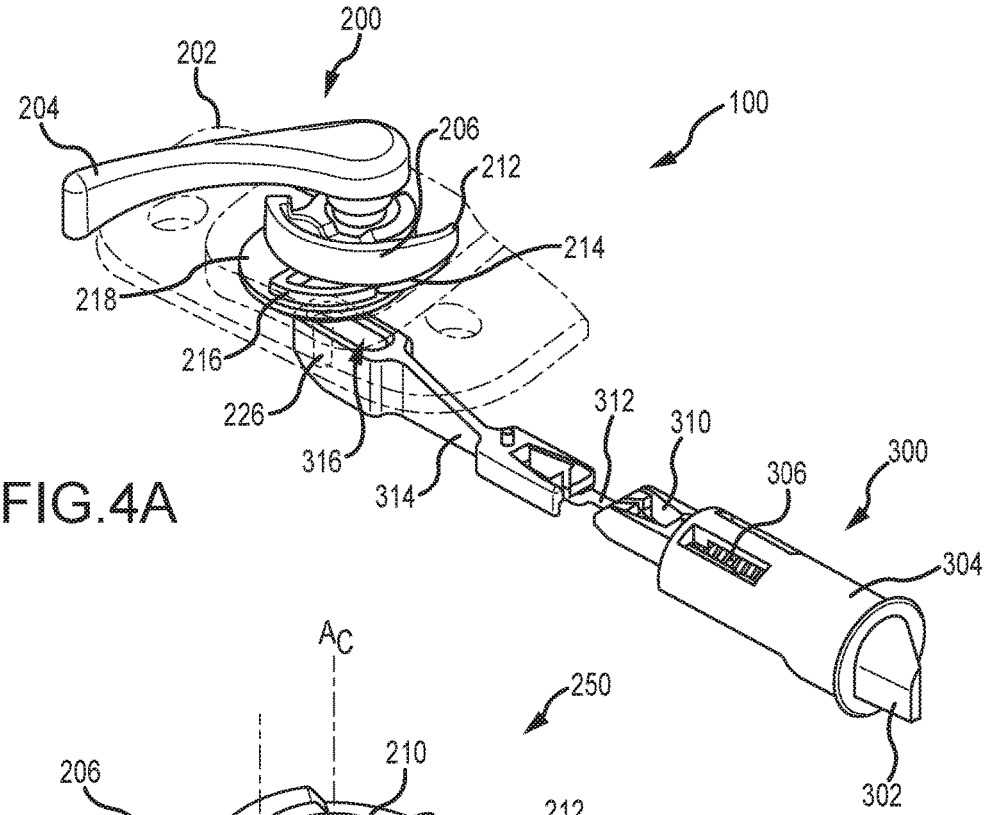
FIG. 4A is a perspective view of the window lock system of FIG. 1, in an ready position.
Figure 4B:
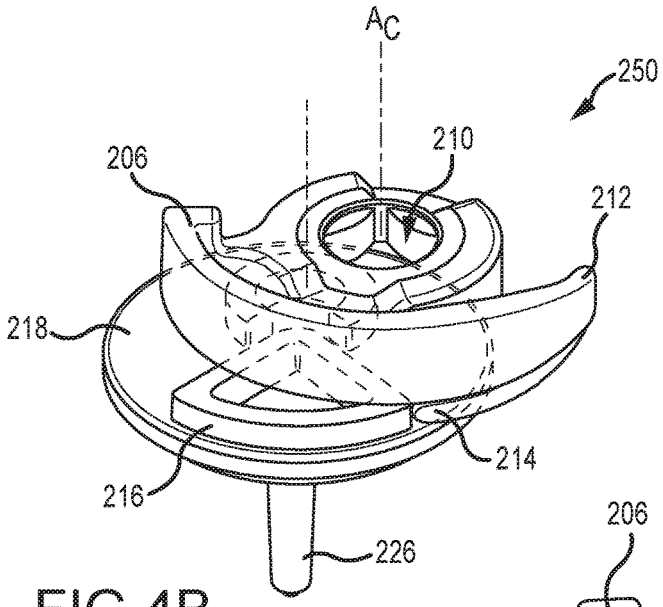
FIG. 4B is a perspective view of the drive system of the window lock system of FIG. 4A, in the ready position.
Figure 4C:
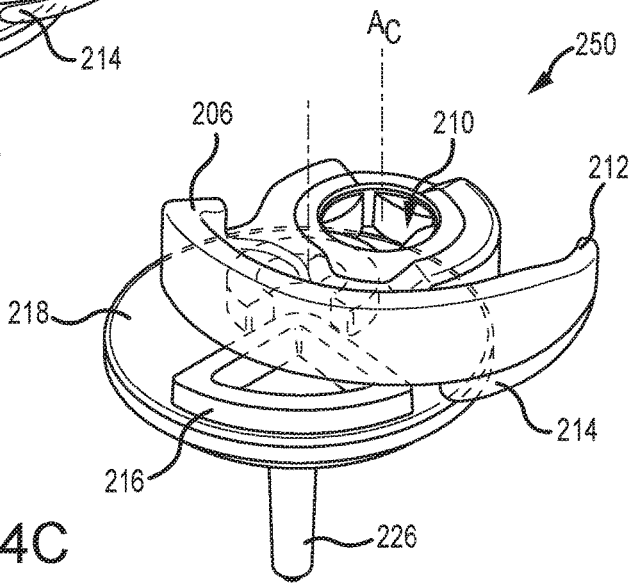
FIG. 4C is a perspective view of the drive system of the window lock system of FIG. 4A, in an unlocked position.

FIG. 4A is a perspective view of the window lock system 100, in a ready position. FIG. 4B is a perspective view of a drive system 250 of the window lock system 100, also in the ready position. FIGS. 4A and 4B are described together. As above, a number of elements are described above with regard to FIGS. 1-2C and, accordingly, are not described further. When the window lock system 100 is in an unlocked position, the lever 204 is in a second position, defined here as about 120 degrees from the locked position. In the unlocked position, the cam surface 212 is disengaged from the keeper, such that the lower sash may be raised and lowered within the window frame. In the depicted embodiment, the cam surface 212 is fully disposed within the housing 202, but in other embodiments, the unlocked position may be reached before the cam surface 212 is completely within the housing 202. In the unlocked position, the cam boss 214 may or may not be engaged with the disc boss 216. One such unlocked position, where the cam boss 214 is not in engaged with the disc boss, is depicted in FIG. 4C. If the cam boss 214 is engaged with the disc boss 216, as depicted in FIG. 4B, this unlocked position may simultaneously be referred to as a ready position, since the drive disc 218 is ready to be rotated due to engagement between the cam boss 214 and the disc boss 216. In the unlocked position or ready position, the latch 302 is not retracted and the spring 306 biases the latch 302 out of the latch housing 304 so as to engage the latch 302 with a jamb channel of the window. This engagement prevents the lower window sash from tilting during lifting and lowering thereof.

Referring again to FIG. 6, the unlocked/ready position is depicted as about 120 degrees from the locked position. As the lever 204 is further rotated, out of the unlocked/ready position and into a retracting range, rotation of the cam 206 rotates the drive disc 218 due to engagement between the cam boss 214 and the disc boss 218. Rotation of the drive disc 218 rotates the cam projection 226, which pulls the linkage 308, so as to retract the latch 302 against the force of the spring 306. The lever 204 is rotated through the retracting range to an unlatched position. In the unlatched position, the latch 302 is out of engagement with the window jamb, such that tilting of the window sash is possible. In the depicted embodiment, this unlatched position is reached when the lever 204 rotates about 60 degrees beyond the unlocked/ready position, and the latch 302 is retracted into the latch housing 304.

Figure 5A:
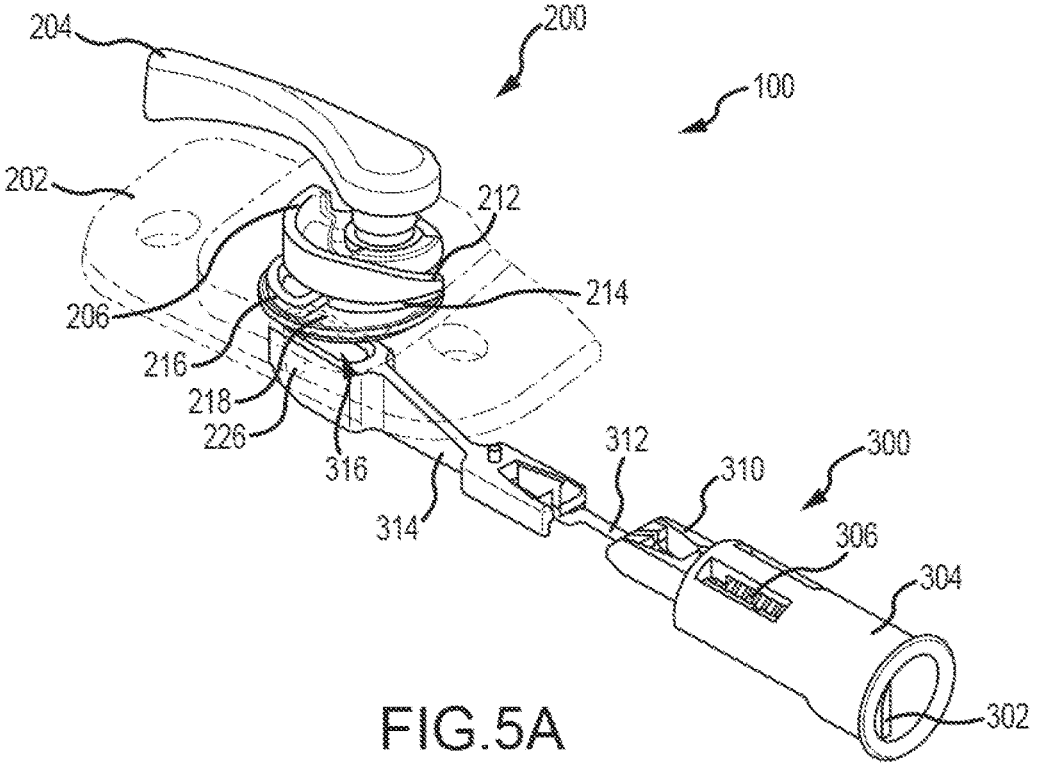
FIG. 5A is a perspective view of the window lock system of FIG. 1, in an unlatched position.
Figure 5B:
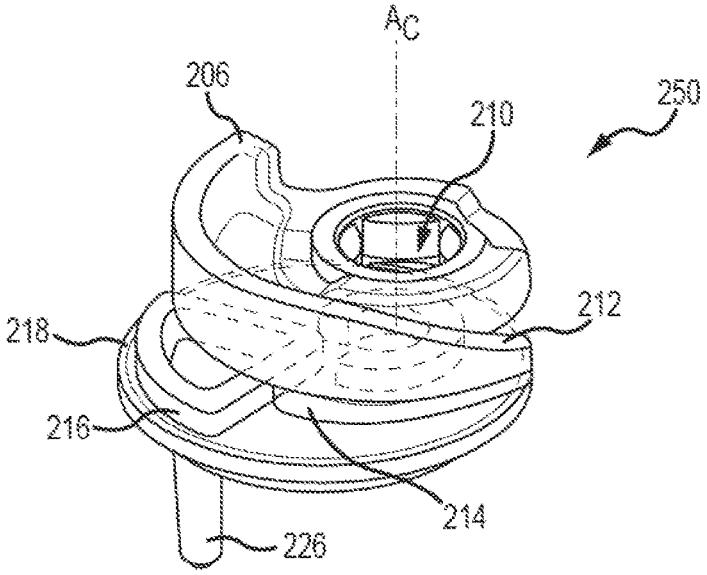
FIG. 5B is a perspective view of the drive system of the window lock system of FIG. 5A, in the unlatched position.

FIG. 5A is a perspective view of the window lock system 100, in an unlatched position. FIG. 5B is a perspective view of a drive system 250 of the window lock system 100, also in the unlatched position. FIGS. 5A and 5B are described together. As above, a number of elements are described above with regard to FIGS. 1-2C and are, accordingly, not described further. When the window lock system 100 is in the unlatched position, the lever 204 is in a third position, defined here as about 180 degrees from the locked position and about 60 degrees from the unlocked/ready position. In the unlatched position, the cam 206 has been rotated through its complete range of motion. In the unlatched position, the cam boss 214 is still fully engaged with the disc boss 216. In the unlatched position, the latch 302 is refracted against the force of the spring 306 so as to disengage the latch 302 with a jamb channel of the window. This position allows the lower window sash to tilt so as to allow cleaning of the outer glass surface of the window sash, removal of the sash, etc. In the depicted embodiment, in the unlatched position, the latch 302 is completely retracted into the latch housing 304.

Referring again to FIG. 6, the unlatched position is depicted as about 180 degrees from the locked position. From this position, if the lever 204 is released, the force of the spring 306 will rotate the drive disc 218 (and therefore the cam 206, due to engagement between the disc boss 216 and the cam boss 214) back to a position consistent with that of the ready position. Once the latch 302 is fully extended by the spring 306, the cam surface 212 will be in the unlocked position, such that the window sash can be raised and lowered within the window jamb. Further rotation of the lever 204 through the unlocking range towards the locked position will ultimately lock the window due to engagement between the cam surface 212 and the keeper. The lever 204 range of motion and positions depicted in FIG. 6 are associated with but one embodiment. Of course, the various positions and, accordingly, the corresponding ranges, may be modified as required or desired for a particular application.

Figure 7:
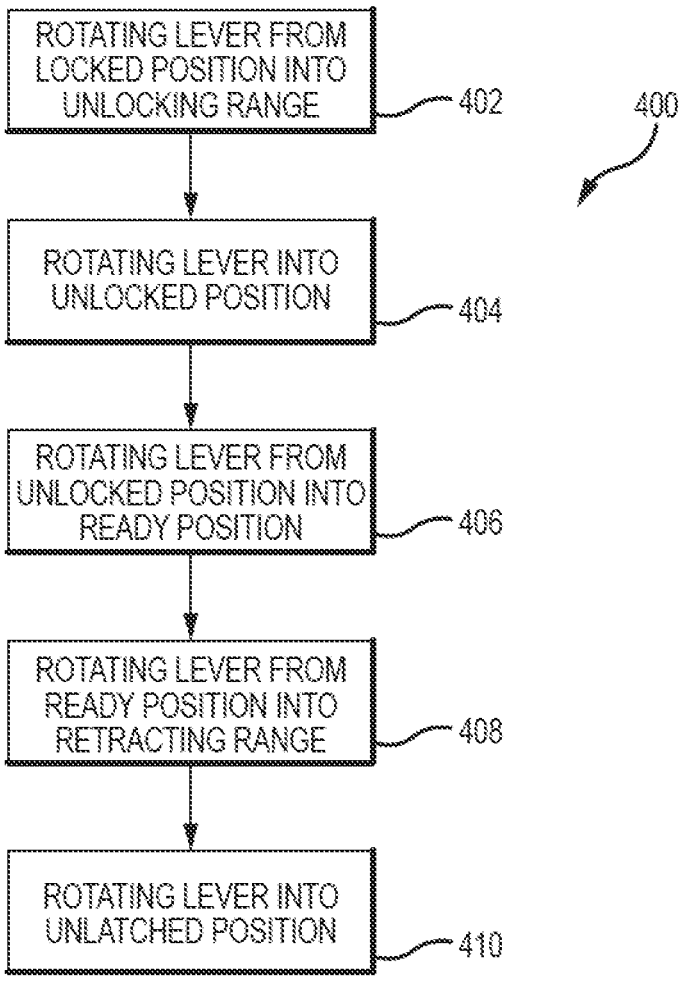
FIG. 7 is a method of operating a window.

FIG. 7 is a method 400 of operating a window. A window lock system that can be used to practice the method 400 may include a window lock system such as the type depicted herein. Such a window lock system includes a window lock having a cam that includes a cam boss and a drive disc that includes a disc boss and a disc projection. The cam is rotated by rotation of a lever. The disc projection is connected via a linkage to a latch disposed in a remote latch housing, and the latch is biased into a position projecting out of the latch housing. Although the method 400 is described in the context of rotation of the lever, lever rotation directly causes rotation of the cam, which rotates the drive disc. Thus, rotation of the lever indirectly rotates the drive disc. Accordingly, movements and positions of the lever correspond directly to movements and positions of the cam and drive disc as well. Additionally, movements and positions of the lever also correspond to similar states of the window (e.g., locked, unlocked, ready, unlatched).

With the window lock system in a locked position, the lever is rotated from a locked position into an unlocking range, operation 402. In the unlocking range, the cam is disengaged with a keeper until the lever is rotated into an unlocked position, operation 404. In the unlocked position, the cam is disengaged such that the associated window sash can be raised from a closed position. The lever may be rotated from an unlocked position into a ready position, operation 406. In certain embodiments, the unlocked position corresponds to the ready position. In the ready position, the cam boss is in engagement with the disc boss. Thereafter, the lever is rotated from the ready position into a retracting range, operation 408. In the retracting range, rotation of the lever rotates the drive disc, due to engagement between the cam boss and the disc boss. Retracting of the latch into the latch housing results as a rotation of the drive disc, the projection from which pulls the linkage to retract the latch. Thereafter, the lever is rotated into the unlatched position, operation 410. In the unlatched position, the latch is fully withdrawn from an associated window jamb and the window sash can be tilted.

Installation of the window lock system depicted herein is simplified as compared to existing systems. The sash may define a conduit extending from the side of the sash that is configured to receive the latch housing and the linkage. The conduit may be in communication with a bore or opening that penetrates the top of the sash. The opening is configured to receive at least the shoulder of the drive disc for smooth rotation thereof. In another embodiment, the opening has an arcuate configuration configured to receive the drive disc projection and the drive disc is disposed on top of the sash, in the housing. To install the window lock system, the linkage and tilt latch are installed from the side of the sash into the conduit. When fully inserted, the linkage extends into the opening and is easily visible therein. The drive disc is then placed in the opening such that the projection engages the linkage opening. The cam is then placed above the drive disc and the housing and lever are then installed above the cam.

The window lock system depicted herein depicts a single window sash lock in conjunction with a single tilt latch, typically for the right hand side of a window sash. This right hand system is used in conjunction with another window lock system, disposed proximate a left hand side of the window sash. Thus, each window sash includes two window lock systems, with the window lock of the first system disposed proximate a right side of the sash, and the window lock of the second system disposed proximate a left side of the sash. Each of these right and left window locks are engaged with a corresponding right and left tilt latch, to release the tilt latch from a corresponding side of the window jamb. Both the right and left window lock systems must be in the unlocked position to raise the window from a closed position, and both the right and left window lock systems must be in the unlatched position to allow tilting of the window sash.

The materials utilized in the manufacture of the window lock system may be those typically utilized for window hardware manufacture, e.g., zinc, steel, brass, stainless steel, etc. Material selection for most of the components may be based on the proposed use of the lock system, level of security desired, etc. Appropriate materials may be selected for a lock system used on windows that have particular security requirements, as well as on lock systems subject to certain environmental conditions (e.g., moisture, corrosive atmospheres, etc.). Nylon, acetal, Teflon®, or combinations thereof may be utilized for various components (e.g., the drive disc) to reduce friction, although other low-friction materials are contemplated. The housing and lever may also be finished by known powder coating processes.

The terms first, second, third, retracted, extended, ready, unlatched, locked, unlocked, upper, lower, etc., as used herein, are relative terms used for convenience of the reader and to differentiate various elements of the window lock system from each other. In general, unless otherwise noted, the terms are not meant to define or otherwise restrict location of any particular element or the relationship between any particular elements.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. An apparatus comprising:

a housing adapted to be secured to a window sash;

a cam rotatably mounted in the housing, wherein the cam comprises a cam surface and a cam boss disposed opposite the cam surface and projecting from an underside surface of the cam; and a drive disc rotatably mounted parallel to the cam, the drive disc comprising:

a top surface;

a bottom surface;

a disc boss extending upwardly from the top surface; and a projection extending downwardly from the bottom surface, the projection disposed opposite the disc boss, wherein the disc boss is configured to contact the underside surface of the cam and the cam boss and disc boss are selectively engageable when the cam is rotated for retracting a tilt latch, wherein the cam comprises a cam axis and the drive disc comprises a disc axis, and wherein the cam axis is offset from the disc axis and both the cam axis and the disc axis pass through the cam and the drive disk.

2. The apparatus of claim 1, wherein the drive disc comprises a spacer projecting from the top surface of the drive disc, wherein the spacer is configured to maintain spacing and alignment between the drive disc and the cam disc.

3. The apparatus of claim 2, wherein the spacer is disposed proximate and discrete from the disc boss.

4. The apparatus of claim 1, wherein the cam is rotatably positionable in:

a locked position, wherein a portion of the cam surface projects from the housing, and wherein the cam boss and the disc boss are not in contact;

an unlocked position, wherein the cam surface is disposed in the housing and wherein the cam boss and disc boss are not in contact; and an unlocked and ready position, wherein the cam surface is fully disposed in the housing and wherein the cam boss and the disc boss are in contact such that a further rotation of the cam rotates the drive disc.

5. The apparatus of claim 4, further comprising:

the tilt latch disposed remote from the housing, wherein the tilt latch comprises:

a latch housing; and a latch movably disposed in the latch housing; and a linkage connecting the latch to the projection.

6. The apparatus of claim 5, wherein when the cam is in the unlocked and ready position, the further rotation of the drive disc moves the linkage so as to retract the latch into the latch housing.

7. The apparatus of claim 6, wherein the cam is rotatably positionable in:

an unlatched position, wherein the cam boss and the disc boss in contact such that a rotation of the cam rotates the drive disc, and wherein the latch is substantially retracted into the latch housing.

8. The apparatus of claim 1, wherein the cam is rotatable about the cam axis, the cam axis is offset from a center point of the drive disc.

9. An apparatus comprising:

a lock comprising:

a lock housing;

a cam rotatably disposed in the lock housing, the cam comprising a cam boss projecting from an underside of the cam and a cam axis; and a drive disc disposed below and parallel to the cam, wherein a rotation of the cam selectively rotates the drive disc, the drive disc comprises:

a bottom surface;

a top surface;

a projection extending downwardly from the bottom surface;

a disc boss extending upwardly from the top surface that is selectively engageable with the cam boss; and a disc axis, wherein the cam axis is offset from the disc axis and both the cam axis and the disc axis pass through the cam and the drive disk;

a tilt latch disposed remote from the lock housing, the tilt latch comprising:

a latch housing;

a latch movably disposed in the latch housing; and a linkage connecting the projection to the latch, wherein the linkage defines an opening configured to receive the projection.

10. The apparatus of claim 9, wherein the apparatus comprises:

a locked position, wherein at least a portion of the cam projects from the lock housing and wherein at least a portion of the latch projects from the latch housing;

an unlocked position, wherein the cam is disposed within the lock housing; and an unlatched position, wherein the latch is retracted into the latch housing.

11. The apparatus of claim 9, further comprising a spring that biases the latch into an extended position projecting from the housing.

12. The apparatus of claim 11, wherein the spring is disposed in the latch housing, and wherein the spring biases the latch so as to rotate the drive disc.

13. The apparatus of claim 9, wherein the drive disc is disposed in the housing.

14. The apparatus of claim 9, wherein the drive disc is disposed remote from the housing.

15. The apparatus of claim 9, wherein the cam comprises a cam surface and the cam boss is disposed opposite the cam surface; and wherein the projection is disposed opposite the disc boss, wherein the cam boss and disc boss are selectively engageable when the cam is rotated.

16. The apparatus of claim 9, wherein each of the drive disc, the tilt latch, and the linkage are adapted to be disposed in a window sash.

* * * * *